US010544478B2

(12) United States Patent
Kimura et al.

(10) Patent No.: US 10,544,478 B2
(45) Date of Patent: Jan. 28, 2020

(54) HIGH-STRENGTH, HIGH-TOUGHNESS STEEL PLATE, AND METHOD FOR PRODUCING THE SAME

(71) Applicant: JFE STEEL CORPORATION, Tokyo (JP)

(72) Inventors: Hideyuki Kimura, Kawasaki (JP); Shusaku Ota, Tokyo (JP); Nobuyuki Ishikawa, Kawasaki (JP); Shinichi Kakihara, Fukuyama (JP); Ryo Nagao, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 139 days.

(21) Appl. No.: 15/562,291

(22) PCT Filed: Mar. 25, 2016

(86) PCT No.: PCT/JP2016/001743
§ 371 (c)(1),
(2) Date: Sep. 27, 2017

(87) PCT Pub. No.: WO2016/157862
PCT Pub. Date: Oct. 6, 2016

(65) Prior Publication Data

US 2018/0340238 A1 Nov. 29, 2018

(30) Foreign Application Priority Data

Mar. 31, 2015 (JP) ..... 2015-071931

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.
CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/26* (2013.01); *C22C 38/28* (2013.01); *C22C 38/38* (2013.01); *C21D 2211/001* (2013.01)

(58) Field of Classification Search
USPC ..... 148/504
See application file for complete search history.

(56) References Cited

U.S. PATENT DOCUMENTS

| | | | | |
|---|---|---|---|---|
| 8,177,925 | B2 | 5/2012 | Takahashi et al. | |
| 9,089,919 | B2 | 7/2015 | Nishimura et al. | |
| 9,181,609 | B2 | 11/2015 | Ishikawa et al. | |
| 2012/0285576 | A1* | 11/2012 | Nishimura ..... | B23K 9/0282 138/177 |
| 2012/0305122 | A1* | 12/2012 | Ishikawa ..... | B23K 9/0282 138/177 |

(Continued)

FOREIGN PATENT DOCUMENTS

| | | | |
|---|---|---|---|
| CA | 2775031 | A1 | 4/2011 |
| CA | 2977017 | A1 | 10/2016 |

(Continued)

OTHER PUBLICATIONS

Chinese Office Action for Chinese Application No. 201680019365.6, dated Jun. 28, 2018, with Concise Statement of Relevance of Office Action, 8 pages.
Extended European Search Report for European Application No. 16 771 750.3, dated Feb. 6, 2018, 8 pages.
Canadian Office Action for Canadian Application No. 2,976,750, dated Aug. 24, 2018, 5 pages.
International Search Report and Written Opinion for International Application PCT/JP2016/001743, dated Jun. 21, 2016—6 Pages.
Chinese Office Action for Chinese Application No. 201680019365.6, dated Jan. 9, 2019 with Concise Statement of Relevance of Office Action, 6 pages.

(Continued)

*Primary Examiner* — Anthony J Zimmer
*Assistant Examiner* — Ricardo D Morales
(74) *Attorney, Agent, or Firm* — RatnerPrestia

(57) ABSTRACT

A high strength/highstrength, high toughness steel sheet having tensile strength, Charpy impact absorption energy, and ductile fracture rate are equal to or greater than specified values comprises, in mass %, 0.03-0.08% of C, 0.01-0.50% of Si, 1.5-2.5% of Mn, 0.001-0.010% of P, 0.0030% or less of S, 0.01-0.08% of Al, 0.010-0.080% of Nb, 0.005-0.025% of Ti, 0.001-0.006% of N, at least one substance selected from among 0.01-1.00% of Cu, 0.01-1.00% of Ni, 0.01-1.00% of Cr, 0.01-1.00% of Mo, 0.01-0.10% of V, and 0.0005-0.0030% of B, and a remainder of Fe and unavoidable impurities. At a position at ½ the sheet thickness, the area ratio of island-like martensite is less than 3%, the area ratio of bainite is 90% or more, and the average particle size of cementite within the bainite is 0.5 μm or less.

8 Claims, No Drawings

(56) References Cited

U.S. PATENT DOCUMENTS

| | | | |
|---|---|---|---|
| 2013/0000793 | A1 | 1/2013 | Ishikawa et al. |
| 2014/0301888 | A1 | 10/2014 | Ichikawa et al. |
| 2015/0090370 | A1 | 4/2015 | Shimamura et al. |
| 2015/0176727 | A1 | 6/2015 | Tanizawa et al. |
| 2018/0057908 | A1 | 3/2018 | Kimura et al. |

FOREIGN PATENT DOCUMENTS

| | | | | |
|---|---|---|---|---|
| CN | 102666898 | A | 9/2012 | |
| CN | 103108971 | A | 5/2013 | |
| CN | 104073744 | A | 10/2014 | |
| EP | 2119803 | A1 | 11/2009 | |
| EP | 2505682 | A1 * | 10/2012 | ..... B23K 9/0282 |
| EP | 2505682 | A1 | 10/2012 | |
| EP | 2617853 | A1 | 7/2013 | |
| JP | 2003096517 | A | 4/2003 | |
| JP | 2006257499 | A | 9/2006 | |
| JP | 2006265722 | A | 10/2006 | |
| JP | 2009127071 | A | 6/2009 | |
| JP | 2009242849 | A | 10/2009 | |
| JP | 2010222681 | A | 10/2010 | |
| JP | 2011132600 | A | 7/2011 | |
| JP | 2011132601 | A | 7/2011 | |
| JP | 2011195883 | A | 10/2011 | |
| JP | 2012241266 | A | 12/2012 | |
| JP | 2013095926 | A | 5/2013 | |
| JP | 2013133476 | A | 7/2013 | |
| JP | 2013204103 | A | 10/2013 | |
| JP | 2013204103 | A * | 10/2013 | |
| JP | 2013227671 | A | 11/2013 | |
| KR | 20090110384 | A | 10/2009 | |
| KR | 20120084804 | A | 7/2012 | |
| KR | 20130006508 | A | 1/2013 | |
| WO | 2013089156 | A1 | 6/2013 | |
| WO | 2013190750 | A1 | 12/2013 | |

OTHER PUBLICATIONS

Korean Office Action for Korean Application No. 10-2017-7027516, dated Dec. 17, 2018 with Concise Statement of Relevance of Office Action, 6 pages.

Korean Office Action for Korean Application No. 10-2017-7027517, dated Jun. 26, 2019 with Concise Statement of Relevance of Office Action, 5 pages.

Korean Office Action for Korean Application No. 10-2017-7027516, dated Jun. 26, 2019 with Concise Statement of Relevance of Office Action, 5 pages.

Non Final Office Action for U.S. Appl. No. 15/562,192, dated May 16, 2019, 11 pages.

Korean Notice of Grant of Patent for Korean Application No. 10-2017-7027516, dated Sep. 5, 2019 with translation, 2 pages.

Final Office Action for U.S. Appl. No. 15/562,192, dated Sep. 27, 2019, 25 pages.

* cited by examiner

HIGH-STRENGTH, HIGH-TOUGHNESS STEEL PLATE, AND METHOD FOR PRODUCING THE SAME

CROSS REFERENCE TO RELATED APPLICATIONS

This is the U.S. National Phase Application of PCT/JP2016/001743, filed Mar. 25, 2016, which claims priority to Japanese Application No. 2015-071931, filed Mar. 31, 2015, the disclosures of these applications being incorporated herein by reference in their entireties for all purposes.

TECHNICAL FIELD OF THE INVENTION

The present invention relates to a high-strength, high-toughness steel plate, and a method for producing the steel plate. Particularly, the invention relates to a high-strength, high-toughness steel plate that has high strength, a high Charpy impact absorbed energy, and excellent DWTT properties and that is suitable as a steel pipe material for a line pipe, and a method for producing the steel plate.

BACKGROUND OF THE INVENTION

Line pipes, which are used for transporting natural gas, crude oil, and the like, have been strongly required to have higher strength in order to improve transport efficiency by using higher pressure and improve on-site welding efficiency by using pipes with thinner walls. In particular, line pipes for transporting high-pressure gas (hereinafter also referred to as high-pressure gas line pipes) are required to have not only material properties such as strength and toughness, which are necessary for general-purpose structural steel, but also material properties related to fracture resistance, which are specific to gas line pipes.

Fracture toughness values of general-purpose structural steel indicate resistance to brittle fracture and are used as indices for making designs so as not to cause brittle fracture during use. For high-pressure gas line pipes, prevention of brittle fracture alone for avoiding catastrophic fracture is not sufficient, and prevention of ductile fracture called unstable ductile fracture is also necessary.

The unstable ductile fracture is a phenomenon where a ductile fracture propagates in a high-pressure gas line pipe in the axial direction of the pipe at a speed of 100 m/s or higher, and this phenomenon can cause catastrophic fracture across several kilometers. Thus, a Charpy impact absorbed energy value and a DWTT (Drop Weight Tear Test) value necessary for preventing unstable ductile fracture are determined from results of past gas burst tests of full-scale pipes, and high Charpy Impact absorbed energies and excellent DWTT properties have been demanded. The DWTT value as used herein refers to a fracture appearance transition temperature at which a percent ductile fracture is 85%.

In response to such a demand, Patent Literature 1 discloses a steel plate for steel pipes that has a composition that forms less ferrite in a natural cooling process after rolling, and a method for producing the steel plate. By performing the rolling at an accumulated rolling reduction ratio at 700° C. or lower of 30% or more, the steel plate has a microstructure including a developed texture and composed mainly of bainite, and the area fraction of ferrite present in prior-austenite grain boundaries is 5% or less, so that the steel plate is provided with a high Charpy impact absorbed energy and excellent DWTT properties.

Patent Literature 2 discloses a method for producing a high-strength, high-toughness steel pipe material having a composition the carbon equivalent (Ceq) of which is controlled to be 0.36 to 0.60, a high Charpy impact absorbed energy, excellent DWTT properties, and a thickness of 20 mm or more, the method including primary rolling at an accumulated rolling reduction ratio of 40% or more in a non-recrystallization temperature range, heating to a recrystallization temperature or higher, cooling to a temperature of $Ar_3$ transformation temperature or lower and ($Ar_3$ transformation temperature −50° C.) or higher, secondary rolling at an accumulated rolling reduction ratio of 15% or more in a two-phase temperature range, and accelerated cooling from a temperature higher than or equal to $Ar_1$ transformation temperature to 600° C. or lower.

Patent Literature 3 discloses a method for producing a high-tensile steel plate for line pipes that has a mixed microstructure composed of 90% or more (by volume) of tempered martensite and lower bainite and has a high Charpy impact absorbed energy and excellent DWTT properties, the method including hot-rolling a steel containing, by mass %, C: 0.04% to 0.12%, Mn: 1.80% to 2.50%, Cu: 0.01% to 0.8%, Ni: 0.1% to 1.0%, Cr: 0.01% to 0.8%, Mo: 0.01% to 0.8%, Nb: 0.01% to 0.08%, V: 0.01% to 0.10%, Ti: 0.005% to 0.025%, and B: 0.0005% to 0.0030% at an accumulated rolling reduction ratio of 50% or more in an austenite non-recrystallization range, performing cooling from a temperature range higher than or equal to $Ar_3$ transformation temperature to a temperature range of Ms temperature or lower and 300° C. or higher at a rate higher than or equal to a critical cooling rate for martensite formation, and performing on-line heating.

Patent Literature 4 discloses a method for producing a high-strength steel plate having a thickness of 15 mm or less. By rolling a steel containing, by mass %, C: 0.03% to 0.1%, Mn: 1.0% to 2.0%, Nb: 0.0.1%, to 0.1%, P≤0.01%, S≤0.003%, and O≤0.005% in a temperature range from ($Ar_3$+80° C.) to 950° C. at an accumulated rolling reduction ratio of 50% or more, performing natural cooling for a while, and performing rolling in a temperature range from $Ar_3$ to ($Ar_3$−30° C.) at an accumulated rolling reduction ratio of 10% to 30%, the steel plate has an undeveloped rolling texture and deformed ferrite, undergoes no separation, and has a high absorbed energy.

Patent Literature 5 discloses a high-tensile steel plate having high toughness, excellent high-speed ductile fracture properties, and high weldability, and a method for producing the steel plate, the method including rolling a steel having a carbon equivalent, expressed by Pcm (=C+Si/30+(Mn+Cu+Cr)/20+Ni/60+Mo/15+V/10+5B), of 0.180% to 0.220% at an accumulated rolling reduction ratio of 50% to 90% in an austenite non-recrystallization temperature range, performing cooling from a temperature higher than or equal to ($Ar_3$−50° C.) at a cooling rate of 10° C./s to 45° C./s, stopping the cooling when the steel plate temperature reaches 300° C. to 500° C., and then performing natural cooling. In the steel plate, the fraction of Martensite-Austenite constituent in a surface portion is 10% or less, the fraction of a mixed microstructure composed of ferrite and bainite in a portion internal to the surface portion is 90% or more, the fraction of bainite in the mixed microstructure is 10% or more, the bainite includes a lath having a thickness of 1 μm or less and a length of 20 μm or less, and the lath in the bainite includes a precipitated cementite particle having a major axis of 0.5 μm or less.

PRIOR ART DOCUMENTS

Patent Literature

PTL 1: Japanese Unexamined Patent Application Publication No. 2010-222681

PTL 2: Japanese Unexamined Patent Application Publication No. 2009-127071

PTL 3: Japanese Unexamined Patent Application Publication No. 2006-265722

PTL 4: Japanese Unexamined Patent Application Publication No. 2003-96517

PTL 5: Japanese Unexamined Patent Application Publication No. 2006-257499

SUMMARY OF THE INVENTION

Technical Problem

In the meantime, a steel plate used for recent high-pressure gas line pipes and the like is required to have higher strength and higher toughness, specifically, a tensile strength of 625 MPa or more, a Charpy impact absorbed energy at −40° C. of 375 J or more, and a percent ductile fracture as determined by a DWTT at −40° C. of 85% or more.

In Patent Literature 1, Charpy impact tests in Examples were performed using test specimens taken from a ¼ position in the thickness direction. Thus, the central portion in the thickness direction where cooling after rolling proceeds slowly may have an unsatisfactory microstructure and poor properties, and the steel plate disclosed in Patent Literature 1 may exhibit low unstable ductile fracture arrestability when used as a steel pipe material for a line pipe.

The method disclosed in Patent Literature 2 involves a reheating process after primary rolling and requires an on-line heating device, and the increased number of manufacturing processes may lead to increased manufacturing cost and reduced rolling efficiency. In addition, Charpy impact tests in Examples were performed using test specimens taken from a ¼ position in the thickness direction, and thus the central portion in the thickness direction may have poor properties, and the steel pipe material disclosed in Patent Literature 2 may exhibit low unstable ductile fracture arrestability when used for a line pipe.

The technique disclosed in Patent Literature 3 is a technique that uses tempered martensite and is related to a high-strength steel plate having a TS≥900 MPa. The steel plate disclosed in Patent Literature 3 has very high strength but does not necessarily have a high Charpy impact absorbed energy, and thus may exhibit low unstable ductile fracture arrestability when used as a steel pipe material for a line pipe. In addition, the accelerated cooling to a temperature range of Ms temperature or lower after rolling may lead to degradation in steel plate shape. Furthermore, the technique requires an on-line heating device, and the increased number of manufacturing processes may lead to increased manufacturing cost and reduced rolling efficiency.

The technique disclosed in Patent Literature 4 involves natural cooling between the rolling in a temperature range from ($Ar_3$+80° C.) to 950° C. at an accumulated rolling reduction ratio of 50% or more and the rolling in a temperature range from $Ar_3$ to ($Ar_3$−30° C.) and thus takes a prolonged rolling time, which may lead to reduced rolling efficiency. In addition, there is no description of DWTT, and brittle fracture arrestability may be poor.

In the technique disclosed in Patent Literature 5, the microstructure internal to the surface portion is substantially a mixed microstructure composed of ferrite and bainite in order to provide high strength and high toughness. However, since an interface between ferrite and bainite may be the initiation site of a ductile crack or a brittle crack, the steel plate disclosed in Patent Literature 5 cannot be said to have a Charpy impact absorbed energy sufficient for use in a harsher environment, for example, at −40° C. and may exhibit poor unstable ductile fracture arrestability when used as a steel pipe material for a line pipe.

The above-described techniques disclosed in Patent Literatures 1 to 5 have not succeeded in stably producing a steel plate having a tensile strength of 625 MPa or more, a Charpy impact absorbed energy at −40° C. of 375 J or more, and a percent ductile fracture as determined by a DWTT at −40° C. of 85% or more.

Thus, in view of the above circumstances, an object of the present invention is to provide a high-strength, high-toughness steel plate having a tensile strength of 625 MPa or more, a Charpy impact absorbed energy at −40° C. of 375 J or more, and a percent ductile fracture as determined by a DWTT at −40° C. of 85% or more, and a method for producing the steel plate.

Solution to Problem

The inventors conducted intensive studies on various factors that affect the Charpy impact absorbed energy and DWTT properties of a steel plate for a line pipe to find out that in producing a steel plate containing C, Mn, Kb, Ti, and other elements, (1) controlling the accumulated rolling reduction ratio and rolling temperature in an austenite non-recrystallization temperature range, and (2) stopping the cooling at a temperature immediately above Ms temperature enables a microstructure composed mainly of bainite with minimum Martensite-Austenite constituent (hereinafter also referred to as MA), and (3) holding the temperature of the steel in the range of the cooling stop temperature ±50° C. enables the average particle size of cementite present in the bainite to be 0.5 μm or less, thereby providing a high-strength, high-toughness steel plate having a high Charpy impact absorbed energy and excellent DWTT properties.

The present invention is summarized as described below.

[1] A high-strength, high-toughness steel plate having a composition containing, by mass %, C: 0.03% or more and 0.08% or less. Si: 0.01% or more and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, N: 0.001% or more and 0.006% or less, and further containing at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and unavoidable impurities, wherein the steel plate has a microstructure in which an area fraction of Martensite-Austenite constituent at a ½ position in a thickness direction is less than 3%, an area fraction of bainite at the ½ position in the thickness direction is 90% or more, and an average particle size of cementite present in the bainite at the ½ position in the thickness direction is 0.5 μm or less.

[2] The high-strength, high-toughness steel plate described in [1] above, wherein the composition further contains, by mass %, at least one selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less.

[3] A method for producing the high-strength, high-toughness steel plate described in [1] or [2] above, the method including heating a steel slab to 1000° C. or higher and 1250° C. or lower, performing rolling in an austenite recrystallization temperature range, performing rolling at an accumulated rolling reduction ratio of 60% or more in an austenite non-recrystallization temperature range, finishing the rolling at a temperature of ($Ar_3$ temperature+50° C.) or higher and ($Ar_3$ temperature+150° C.) or lower, performing accelerated cooling from a cooling start temperature of $Ar_3$ temperature or higher and ($Ar_3$ temperature+100° C. or lower to a cooling stop temperature of Ms temperature or higher and (Ms temperature+100° C.) or lower at a cooling rate of 10° C./s or more and 80° C./s or less, holding the temperature of the steel in the range of the cooling stop temperature ±50° C. for 50 s or longer and shorter than 300 s, and then performing natural cooling to a temperature range of 100° C. or lower.

In the present invention, every temperature in production conditions is an average steel plate temperature unless otherwise specified. The average steel plate temperature can be determined from thickness, surface temperature, cooling conditions, and other conditions by simulation calculation or other methods. For example, the average temperature of a steel plate can be determined by calculating the temperature distribution in the thickness direction using a difference method.

Advantageous Effects of Invention

According to the present invention, properly controlling the rolling conditions and the cooling conditions after rolling enables a steel microstructure composed mainly of bainite and enables the average particle size of cementite present in the bainite to be 0.5 μm or less. This results in a steel plate that includes a base metal having a tensile strength of 625 MPa or more, a Charpy impact absorbed energy at −40° C. of 375 J or more, and a percent ductile fracture (SA value) as determined by a DWTT at −40° C. of 85% or more, which is industrially extremely useful.

DESCRIPTION OF EMBODIMENTS

The present invention will now be described in detail.

A high-strength, high-toughness steel plate according to the present invention is a steel plate having a composition containing, by mass %, C: 0.03% or more and 0.08% or less, Si: 0.01% or more and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, N: 0.001% or more and 0.006% or less, and further containing at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and unavoidable impurities. The steel plate has a microstructure in which at the ½ position in the thickness direction, the area fraction of Martensite-Austenite constituent is less than 3% and the area fraction of bainite is 90% or more, and the average particle size of cementite present in the bainite is 0.5 μm or less.

First, reasons for the limitations on the composition of the present invention will be described. It is to be noted that percentages regarding components are by mass %.

C: 0.03% or More and 0.08% or Less

C forms a microstructure composed mainly of bainite after accelerated cooling and is effective in increasing strength through transformation strengthening. However, a C content of less than 0.03% tends to cause ferrite transformation or pearlite transformation during cooling and thus may fail to form a predetermined amount of bainite and provide the desired tensile strength (≥625 MPa). A C content of more than 0.08% tends to form hard martensite after accelerated cooling and may result in a base metal having a low Charpy impact absorbed energy and poor DWTT properties. Thus, the C content is 0.03% or more and 0.08% or less, preferably 0.03% or more and 0.07% or less.

Si: 0.01% or More and 0.50% or Less

Si is an element necessary for deoxidization and further improves steel strength through solid-solution strengthening. To produce such an effect, Si needs to be contained in an amount of 0.01% or more and is preferably contained in an amount of 0.05% or more, still more preferably 0.10% or more. A Si content of more than 0.50% results in poor weldability and a base metal having a low Charpy impact absorbed energy, and thus the Si content is 0.01% or more and 0.50% or less. To prevent softening of a weld zone of a steel pipe and a reduction in toughness of a weld heat affected zone of the steel pipe, the Si content is preferably 0.01% or more and 0.20% or less.

Mn: 1.5% or More and 2.5% or Less

Mn, similarly to C, forms a microstructure composed mainly of bainite after accelerated cooling and is effective in increasing strength through transformation strengthening. However, a Mn content of less than 1.5% tends to cause ferrite transformation or pearlite transformation during cooling and thus may fail to form a predetermined amount of bainite and provide the desired tensile strength (≥625 MPa). A Mn content of more than 2.5% results in a concentration of Mn in a segregation part inevitably formed during casting, causing the part to have a low Charpy impact absorbed energy and poor DWTT properties, and thus the Mn content is 1.5% or more and 2.5% or less. To improve toughness, the Mn content is preferably 1.5% or more and 2.0% or less.

P: 0.001% or More and 0.010% or Less

P is an element effective in increasing the strength of the steel plate through solid-solution strengthening. However, a P content of less than 0.001% may not only fail to produce the effect but also cause an increase in dephosphorization cost in a steel-making process, and thus the P content is 0.001% or more. A P content of more than 0.010% results in significantly low toughness and weldability. Thus, the P content is 0.001% or more and 0.010% or less.

S: 0.0030% or Less

S is a harmful element that causes hot brittleness and reduces toughness and ductility by forming sulfide-based inclusions in the steel. Thus, the S content is preferably as low as possible. In the present invention, the upper limit of the S content is 0.0030%, preferably 0.0015%. Although there is no lower limit, the S content is preferably at least 0.0001% because an extremely low S content causes an increase in steel-making cost.

Al: 0.01% or More and 0.08% or Less

Al is an element added as a deoxidizer. Al has a solid-solution strengthening ability and thus is effective in increasing the strength of the steel plate. However, an Al content of less than 0.01% may fail to produce the effect. An Al content of more than 0.08% may cause an increase in raw material cost and also reduce toughness. Thus, the Al content is 0.01% or more and 0.08% or less, preferably 0.01% or more and 0.05% or less.

Nb: 0.010% or More and 0.080% or Less

Nb is effective in increasing the strength of the steel plate through precipitation strengthening or a hardenability-improving effect. Nb also widens an austenite non-recrystallization temperature range in hot rolling and is effective in improving toughness through a grain refining effect of rolling in the austenite non-recrystallization range. To produce these effects, Nb is contained in an amount of 0.010% or more. A Nb content of more than 0.080% tends to form hard martensite after accelerated cooling, which may result in a base metal having a low Charpy impact absorbed energy and poor DWTT properties and a HAZ (hereinafter also referred to as a weld heat affected zone) having significantly low toughness. Thus, the Nb content is 0.010% or more and 0.080% or less, preferably 0.010% or more and 0.040% or less.

Ti: 0.005% or More and 0.025% or Less

Ti forms nitrides (mainly TiN) in the steel and, particularly when contained in an amount of 0.005% or more, refines austenite grains through a pinning effect of the nitrides, thus contributing to providing a base metal and a weld heat affected zone with sufficient toughness. In addition, Ti is an element effective in increasing the strength of the steel plate through precipitation strengthening. To produce these effects, Ti is contained in an amount of 0.005% or more. A Ti content of more than 0.025% forms coarse TiN etc., which does not contribute to refining austenite grains and fails to provide improved toughness. In addition, the coarse TiN may be the initiation site of a ductile crack or a brittle crack, thus resulting in a significantly low Charpy impact absorbed energy and significantly poor DWTT properties. Thus, the Ti content is 0.005% or more and 0.025% or less, preferably 0.008% or more and 0.018% or less.

N: 0.001% or more and 0.006% or less

N forms a nitride together with Ti to inhibit austenite from being coarsened, thus contributing to improving toughness. To produce such a pinning effect, N is contained in an amount of 0.001% or more. A N content of more than 0.006% may result in that when TiN is decomposed in a weld zone, particularly in a weld heat affected zone heated to 1450° C. or higher in the vicinity of a fusion line, solid solute N causes degradation of the toughness of the weld heat affected zone. Thus, the N content is 0.001% or more and 0.006% or less, and when a high level of toughness is required for the weld heat affected zone, the N content is preferably 0.001% or more and 0.004% or less.

In the present invention, in addition to the above-described essential elements, at least one selected from Cu, Ni, Cr, Mo, V, and B is further contained as a selectable element.

Cu: 0.01% or More and 1.00% or Less, Cr: 0.01% or More and 1.00% or Less, Mo: 0.01% or More and 1.00% or Less Cu, Cr, and Mo are all elements for improving hardenability and, similarly to Mn, form a low-temperature transformation microstructure to contribute to providing a base metal and a weld heat affected zone with increased strength. To produce this effect, these elements need to be contained each in an amount of 0.01% or more. However, the strength-increasing effect becomes saturated when the Cu content, the Cr content, and the Mo content are each more than 1.00%. Thus, when Cu, Cr, or Mo is contained, the amount thereof is 0.01% or more and 1.00% or less.

Ni: 0.01% or More and 1.00% or Less

Ni is also an element for improving hardenability and is useful because it causes no reduction in toughness when contained. To produce this effect, Ni needs to be contained in an amount of 0.01% or more. However, Ni is very expensive, and the effect becomes saturated when the Ni content is more than 1.00%. Thus, when Ni is contained, the amount thereof is 0.01% or more and 1.00% or less.

V: 0.01% or More and 0.10% or Less

V is an element that forms a carbide and is effective in increasing the strength of the steel plate through precipitation strengthening. To produce this effect, V needs to be contained in an amount of 0.01% or more. A V content of more than 0.10% may form an excessive amount of carbide, leading to reduced toughness. Thus, when V is contained, the amount thereof is 0.01% or more and 0.10% or less.

B: 0.0005% or More and 0.0030% or Less

B segregates at austenite grain boundaries to suppress ferrite transformation, thereby contributing to preventing a reduction in strength, particularly of the weld heat affected zone. To produce this effect, B needs to be contained in an amount of 0.0005% or more. However, the effect becomes saturated when the B content is more than 0.0030%. Thus, when B is contained, the amount thereof is 0.0005% or more and 0.0030% or less.

The balance of the composition is Fe and unavoidable impurities, and one or more selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less may be optionally contained.

Ca, REM, Zr, and Mg each have a function to immobilize S in steel to improve the toughness of the steel plate. This effect appears when these elements are contained in an amount of 0.0005% or more. A Ca content of more than 0.0100%, a REM content of more than 0.0200%, a Zr content of more than 0.0300%, or a Mg content of more than 0.0100% may result in increased inclusions in steel, leading to reduced toughness. Thus, when these elements are contained, the amount thereof is as follows: Ca: 0.0005% or more and 0.0100% or less, REM: 0.0005% or more and 0.0200% or less, Zr: 0.0005% or more and 0.0300% or less, Mg: 0.0005% or more and 0.0100% or less.

The microstructure will now be described.

To reliably provide a base metal having a tensile strength of 625 MPa or more, a Charpy impact absorbed energy at −40° C. of 375 J or more, and a percent ductile fracture (SA value) as determined by a DWTT at −40° C. of 85% or more, the microstructure of the high-strength, high-toughness steel plate according to the present invention needs to be a microstructure composed mainly of bainite in which the area fraction of Martensite-Austenite constituent is less than 3% and in which the average particle size of cementite present in the bainite is 0.5 μm or less. Here, the microstructure composed mainly of bainite means a microstructure having a bainite area fraction of 90% or more and composed substantially of bainite. The other constituents may include, in addition to the Martensite-Austenite constituent in an area fraction of less than 3%, phases other than bainite, such as ferrite, pearlite, and martensite. The effects of the present invention can be produced if the total area fraction of the other constituents is 10% or less.

Martensite-Austenite Constituent Area Fraction at ½ Position in Thickness Direction: Less Than 3%

Martensite-Austenite constituent has high hardness and may be the initiation site of a ductile crack or a brittle crack, and thus a Martensite-Austenite constituent area fraction of 3% or more results in a significantly low Charpy impact absorbed energy and significantly poor DWTT properties. A Martensite-Austenite constituent area fraction of less than 3% will not result in a low Charpy impact absorbed energy or poor DWTT properties, and thus in the present invention, the Martensite-Austenite constituent area fraction at the ½ position in the thickness direction is limited to less than 3%. The Martensite-Austenite constituent area fraction is preferably 2% or less.

Bainite Area Fraction at ½ Position in Thickness Direction: 90% or More

The bainite is a hard phase and is effective in increasing the strength of the steel plate through transformation microstructure strengthening. The microstructure composed mainly of bainite enables increased strength while stabilizing the Charpy impact absorbed energy and the DWTT properties at high levels. When the bainite area fraction is less than 90%, the total area fraction of the other constituents such as ferrite, pearlite, martensite, and Martensite-Austenite constituent is 10% or more. In such a composite microstructure, an interface among different phases may be the initiation site of a ductile crack or a brittle crack, leading to an insufficient Charpy impact absorbed energy and insufficient DWTT properties. Thus, the bainite area fraction at the ½ position in the thickness direction is 90% or more, preferably 95% or more. The bainite as used herein refers to a lath-shaped bainitic ferrite in which cementite particles precipitate.

Average Particle Size of Cementite Present in Bainite at ½ Position in Thickness Direction: 0.5 μm or Less Cementite in bainite may be the initiation site of a ductile crack or a brittle crack, and an average cementite particle size of more than 0.5 μm results in a significantly low Charpy impact absorbed energy and significantly poor DWTT properties. However, when the average particle size of cementite in bainite is 0.5 μm or less, decreases in these properties are minor and the desired properties can be obtained. Thus, the average cementite particle size is 0.5 μm or less, preferably 0.2 μm or less.

Here, the bainite area fraction described above can be determined as follows: an L cross-section (a vertical cross-section parallel to a rolling direction) taken from the ½ position in the thickness direction is mirror-polished and then etched with nital; five fields of view are randomly selected and observed using a scanning electron microscope (SEM) at a magnification of 2000×; microstructural images are taken to identify a microstructure; and the microstructure is subjected to image analysis to determine the area fraction of phases such as bainite, martensite, ferrite, and pearlite. The Martensite-Austenite constituent area fraction can be determined as follows: the same sample is electrolytically etched (electrolyte: 100 ml of distilled water+25 g of sodium hydroxide+5 g of picric acid) to expose Martensite-Austenite constituent; five fields of view are randomly selected and observed under a scanning electron microscope (SEM) at a magnification of 2000×; and microstructural images taken are subjected to image analysis. The average particle size of cementite can be determined as follows: mirror polishing is performed again; cementite is extracted by selective potentiostatic electrolytic etching by electrolytic dissolution method (electrolyte: 10% by volume acetylacetone+1% by volume tetramethylammonium chloride methyl alcohol); five fields of view are randomly selected and observed using a SEM at a magnification of 2000×; microstructural images taken are subjected to image analysis; and equivalent circle diameters of cementite particles are averaged.

Since the metallographic structure of a steel plate produced using accelerated cooling generally varies in the thickness direction of the steel plate, the microstructure at the ½ position in the thickness direction (½ t position, where t is a thickness) where cooling proceeds slowly and the above-described properties are difficult to achieve is determined in order to reliably satisfy the desired strength and Charpy impact absorbed energy. That is to say, if the microstructure at the ½ position in the thickness direction satisfies the above-described requirements, the above-described requirements should be satisfied also at a ¼ position in the thickness direction, but even if the microstructure at the ¼ position in the thickness direction satisfies the above-described requirements, the above-described requirements should not necessarily be satisfied at the ½ position in the thickness direction.

The above-described high-strength, high-toughness steel plate having a high absorbed energy according to the present invention has the following properties.

(1) Base metal tensile strength of 625 MPa or more: Line pipes, which are used for transporting natural gas, crude oil, and the like, have been strongly required to have higher strength in order to improve transport efficiency by using higher pressure and improve on-site welding efficiency by using pipes with thinner walls. To meet such a demand, the tensile strength of a base metal is 625 MPa in the present invention. The tensile strength can be determined by preparing a full-thickness tensile test specimen in accordance with API-5L whose tensile direction is a C direction and performing a tensile test. According to the composition and the microstructure of the present invention, base metal tensile strengths of up to about 850 MPa can be achieved without any problem.

(2) Charpy impact absorbed energy at −40° C. of 375 J or more: A high-pressure gas line pipe is known to experience a high-speed ductile fracture (unstable ductile fracture), which is a phenomenon where a ductile crack due to an external cause propagates in the axial direction of the pipe at a speed of 100 m/s or higher, and this phenomenon can cause catastrophic fracture across several kilometers. A higher absorbed energy effectively prevents such a high-speed ductile fracture, and thus in the present invention, the Charpy impact absorbed energy at −40° C. is 375 J or more, preferably 400 J or more. The Charpy impact absorbed energy at −40° C. can be determined by performing a Charpy impact test in accordance with ASTM A370 at −40° C.

(3) Percent ductile fracture (SA value) as determined by DWTT at −40° C. of 85% or more: Line pipes, which are used for transporting natural gas and the like, are required to have higher percent ductile fracture values as determined by a DWTT in order to prevent brittle crack propagation. In the present invention, the percent ductile fracture (SA value) as determined by a DWTT at −40° C. is 85% or more. The percent ductile fracture (SA value) as determined by a DWTT at −40° C. can be determined from the fractured surface of the sample subjected to an impact bending load to the sample at −40° C. using a drop weight to fracture, where the sample is a press-notched full-thickness DWTT test specimen whose longitudinal direction is a C direction in accordance with API-5L.

A method for producing the high-strength, high-toughness steel plate according to the present invention will now be described.

The method for producing the high-strength, high-toughness steel plate according to the present invention includes heating a steel slab having the above-described composition to 1000° C. or higher and 1250° C. or lower, performing rolling in an austenite recrystallization temperature range, performing rolling at an accumulated rolling reduction ratio of 60% or more in an austenite non-recrystallization temperature range, finishing the rolling at a temperature of ($Ar_3$ temperature+50° C.) or higher and ($Ar_3$ temperature+150° C.) or lower, performing accelerated cooling from a temperature from $Ar_3$ temperature or higher and ($Ar_3$ temperature+100° C.) or lower to a cooling stop temperature of Ms temperature or higher and (Ms temperature+100° C.) or lower at a cooling rate of 10° C./s or more and 80° C./s or less, holding the temperature in the range of the cooling stop temperature±50° C. for 50 s or longer and shorter than 300 s, and then performing natural cooling to a temperature range of 100° C. or lower.

Slab Heating Temperature: 1000° C. or Higher and 1250° C. or Lower

The steel slab in the present invention is preferably produced by continuous casting in order to prevent macro-segregation of constituents and may also be produced by ingot casting. After the steel slab is produced, (1) a conventional method in which the steel slab is once cooled to room temperature and then reheated, and an energy-saving process such as (2) hot direct rolling in which the hot steel slab left uncooled is charged into a heating furnace and hot-rolled, (3) hot direct rolling in which the steel slab is kept hot for a short period of time and then immediately hot-rolled, or (4) a method in which the steel slab left in a hot state is charged into a heating furnace so that reheating is partially omitted (i.e., hot slab charging) can be employed without any problem.

A heating temperature of lower than 1000° C. may fail to sufficiently dissolve carbides of Nb, V, and other elements in the steel slab and produce a strength-increasing effect of precipitation strengthening. A heating temperature of higher than 1250° C. coarsens initial austenite grains and thus may result in a base metal having a low Charpy impact absorbed energy and poor DWTT properties. Thus, the slab heating temperature is 1000° C. or higher and 1250° C. or lower, preferably 1000° C. or higher and 1150° C. or lower.

Accumulated Rolling Reduction Ratio in Austenite Recrystallization Temperature Range: 50% or More (Preferred Range)

By performing rolling in an austenite recrystallization temperature range after the slab is heated and held, austenite grains become fine through recrystallization, thereby contributing to improvements in Charpy impact absorbed energy and DWTT properties of a base metal. The accumulated rolling reduction ratio in a recrystallization temperature range is preferably, but not necessarily, 50% or more. Within the steel composition range of the present invention, the lower temperature limit of austenite recrystallization range is approximately 950° C.

Accumulated Rolling Reduction Ratio in Austenite Non-recrystallization Temperature Range: 60% or More By performing rolling in an austenite non-recrystallization temperature range at an accumulated rolling reduction ratio of 60% or more, austenite grains become elongated and become fine particularly in the thickness direction, and performing accelerated cooling to the hot-rolled steel in this state provides a steel having a satisfactory Charpy impact absorbed energy and DWTT properties. A rolling reduction ratio of less than 60% may fail to produce a sufficient grain refining effect, leading to an insufficient Charpy impact absorbed energy and insufficient DWTT properties. Thus, the accumulated rolling reduction ratio in an austenite non-recrystallization temperature range is 60% or more, and when more improved toughness is required, the accumulated rolling reduction ratio is preferably 70% or more.

Rolling Finish Temperature: ($Ar_3$ Temperature+50° C.) or Higher and ($Ar_3$ Temperature+150° C.) or Lower A heavy rolling reduction at a high accumulated rolling reduction ratio in an austenite non-recrystallization temperature range is effective in improving Charpy impact absorbed energy and DWTT properties, and this effect is further increased by performing a rolling reduction in a lower temperature range. However, rolling in a low-temperature range lower than ($Ar_3$ temperature+50° C.) develops a texture in austenite grains, and when accelerated cooling is performed after this to form a microstructure composed mainly of bainite, the texture is partially transferred to the transformed microstructure. This increases the likelihood of separation and leads to a significantly low Charpy impact absorbed energy. Rolling finish temperature higher than ($Ar_3$ temperature+150° C.) may fail to produce a sufficient grain refining effect that is effective in improving DWTT properties. Thus, the rolling finish temperature is ($Ar_3$ temperature+50° C.) or higher and ($Ar_3$ temperature+150° C.) or lower.

Cooling Start Temperature of Accelerated Cooling: $Ar_3$ Temperature or Higher and ($Ar_3$ Temperature+100° C.) or Lower A cooling start temperature of accelerated cooling of lower than $Ar_3$ temperature may lead to the formation of pro-eutectoid ferrite from austenite grain boundaries during a natural cooling process from after hot rolling to the start of accelerated cooling, resulting in low strength of base metal. An increase in pro-eutectoid ferrite formation may increase the number of ferrite-bainite interfaces which may be the initiation site of a ductile crack or a brittle crack, thus resulting in a low Charpy impact absorbed energy and poor DWTT properties. A cooling start temperature of higher than ($Ar_3$ temperature+100° C.), which means a high rolling finish temperature, may fail to produce a sufficient microstructure-refining effect that is effective in improving DWTT properties. In addition, a cooling start temperature of higher than ($Ar_3$ temperature+100° C.) may facilitate the recovery and growth of austenite grains even if the time of natural cooling from after rolling to the start of accelerated cooling is short, resulting in low toughness of base metal. Thus, the cooling start temperature of accelerated cooling is $Ar_3$ temperature or higher and ($Ar_3$ temperature+100° C.) or lower.

Cooling Rate in Accelerated Cooling: 10° C./s or More and 80° C./s or Less

A cooling rate in accelerated cooling of less than 10° C./s may cause ferrite transformation during cooling, resulting in low strength of base metal. An increase in ferrite formation increases the number of ferrite-bainite interfaces which may be the initiation site of a ductile crack or a brittle crack, which may result in a low Charpy impact absorbed energy and poor DWTT properties. A cooling rate in accelerated cooling of more than 80° C./s causes martensite transformation, particularly near the surface of the steel plate, resulting in a base metal having a significantly low Charpy impact absorbed energy and significantly poor DWTT properties although having increased strength. Thus, the cooling rate in accelerated cooling is 10° C./s or more and 80° C./s or less, preferably 20° C./s or higher and 60° C./s or lower. The cooling rate refers to an average cooling rate obtained by dividing a difference between a cooling start temperature and a cooling stop temperature by the time required.

Cooling Stop Temperature of Accelerated Cooling: Ms Temperature or Higher and (Ms Temperature+100° C.) or Lower A cooling stop temperature of accelerated cooling of lower than Ms temperature may cause martensite transformation, resulting in a base metal having a significantly low Charpy impact absorbed energy and significantly poor DWTT properties although having increased strength. This tendency is strong, particularly near the surface of the steel plate. A cooling stop temperature of higher than (Ms temperature+100° C.) may lead to the formation of coarse cementite and the formation of Martensite-Austenite constituent through bainite transformation, during the natural cooling process after stopping the cooling, resulting in a low Charpy impact absorbed energy and poor DWTT properties. Thus, the cooling stop temperature of accelerated cooling is Ms temperature or higher and (Ms temperature+100° C.) or lower, preferably Ms temperature or higher and (Ms temperature+60° C.) or lower.

Holding After Accelerated Cooling: in Temperature Range of Cooling Stop Temperature±50° C. for 50 s or Longer and Shorter Than 300 s Holding conditions after accelerated cooling need to be properly controlled in order to control the average particle size of cementite present in bainite and provide a high Charpy impact absorbed energy and excellent DWTT properties. A holding temperature after accelerated cooling of lower than (cooling stop temperature−50° C.) cannot cause supersaturated solute carbon in bainite, which is formed by transformation as a result of cooling, to precipitate sufficiently in the form of cementite, resulting in a base metal having a low Charpy impact absorbed energy and poor DWTT properties. A holding temperature of higher than (cooling stop temperature+50° C.) causes cementite in bainite to coagulate and be coarsened, resulting in a base metal having a significantly low Charpy impact absorbed energy and significantly poor DWTT properties. Thus, the holding temperature after accelerated cooling is (cooling stop temperature±50° C.).

A holding time after accelerated cooling of shorter than 50 s cannot cause supersaturated solute carbon in bainite, which is formed by transformation as a result of cooling, to precipitate sufficiently in the form of fine cementite, resulting in a base metal having low toughness. A holding time of 300 s or longer causes cementite in bainite to coagulate and be coarsened, resulting in a base metal having a significantly low Charpy impact absorbed energy and significantly poor DWTT properties. Thus, the holding time after accelerated cooling is 50 s or longer and shorter than 300 s.

Natural Cooling to Temperature Range of 100° C. or Lower (Room Temperature)

After holding the temperature in the range of the cooling stop temperature ±50° C. for 50 s or longer and shorter than 300 s after the accelerated cooling, natural cooling is performed to a temperature range of 100° C. or lower (room temperature).

After the accelerated cooling described above, reheating is preferably not performed. More specifically, reheating to 350° C. or higher is preferably not performed.

Values of $Ar_3$ temperature and Ms temperature used in the present invention are calculated using the following formulas based on element contents of a steel. Symbols of elements in the formulas respectively denote the content (mass %) of the corresponding element of a steel. The symbol of an element which is not included is assigned a value of 0.

$$Ar_3\ (°\ C.)=910-310C-80Mn-20Cu-15Cr-55Ni-80Mo$$

$$Ms\ (°\ C.)=550-361C-39Mn-35V-20Cr-17Ni-10Cu-5(Mo+W)+15Co+30Al$$

The steel plate of the present invention produced through the rolling process described above is suitable for use as a raw material for a high-strength line pipe. When a high-strength line pipe is produced using the steel plate of the present invention, the steel plate is formed into a substantially cylindrical shape by U-press and O-press, or press bending which involves repeated three-point bending, and welded, for example, by submerged arc welding to form a welded steel pipe, and the welded steel pipe is expanded into a predetermined shape. The high-strength line pipe thus produced may be surface-coated and/or subjected to a heat treatment for toughness improvement or other purposes, if necessary.

EXAMPLE 1

Examples of the invention will now be described.

Molten steels having compositions (the balance is Fe and unavoidable impurities) shown in Table 1 were each smelted in a converter and cast into a slab having a thickness of 220 mm. The slab was then subjected to hot rolling, accelerated cooling, holding after accelerated cooling under conditions shown in Table 2 and naturally cooled to a temperature range of 100° C. or lower (room temperature) to produce a steel plate having a thickness of 25 mm.

TABLE 1

| Steel | Chemical Component (mass %) | | | | | | | | | | | | |
|---|---|---|---|---|---|---|---|---|---|---|---|---|---|
| No. | C | Si | Mn | P | S | Al | Nb | Ti | N | Cu | Ni | Cr | Mo |
| A | 0.02 | 0.15 | 1.5 | 0.007 | 0.0006 | 0.03 | 0.030 | 0.015 | 0.005 | 0.40 | 0.30 | 0.25 | 0.20 |
| B | 0.04 | 0.20 | 1.8 | 0.006 | 0.0005 | 0.03 | 0.035 | 0.008 | 0.004 | — | — | 0.30 | 0.30 |
| C | 0.05 | 0.10 | 1.9 | 0.006 | 0.0006 | 0.03 | 0.040 | 0.010 | 0.004 | — | — | 0.20 | 0.30 |
| D | 0.06 | 0.15 | 1.8 | 0.007 | 0.0004 | 0.03 | 0.030 | 0.010 | 0.003 | — | — | 0.15 | 0.25 |
| E | 0.06 | 0.05 | 1.8 | 0.005 | 0.0005 | 0.03 | 0.015 | 0.015 | 0.003 | — | — | — | 0.35 |
| F | 0.06 | 0.15 | 1.8 | 0.007 | 0.0008 | 0.05 | 0.030 | 0.015 | 0.004 | 0.30 | 0.30 | — | 0.30 |
| G | 0.07 | 0.20 | 1.8 | 0.008 | 0.0011 | 0.04 | 0.035 | 0.015 | 0.003 | 0.25 | 0.20 | — | 0.25 |
| H | 0.08 | 0.15 | 1.7 | 0.007 | 0.0014 | 0.05 | 0.035 | 0.015 | 0.003 | 0.35 | 0.35 | — | — |
| I | 0.07 | 0.15 | 2.2 | 0.006 | 0.0021 | 0.06 | 0.040 | 0.015 | 0.005 | 0.35 | 0.25 | — | — |
| J | 0.05 | 0.30 | 2.4 | 0.007 | 0.0023 | 0.06 | 0.055 | 0.020 | 0.005 | — | — | 0.10 | 0.10 |
| K | 0.08 | 0.45 | 1.9 | 0.005 | 0.0019 | 0.05 | 0.070 | 0.025 | 0.004 | 0.25 | 0.20 | — | — |
| L | 0.06 | 0.20 | 1.7 | 0.008 | 0.0022 | 0.02 | 0.075 | 0.020 | 0.004 | — | — | 0.20 | 0.25 |
| M | 0.07 | 0.20 | 1.8 | 0.006 | 0.0017 | 0.03 | 0.065 | 0.020 | 0.004 | 0.40 | 0.30 | — | — |
| N | 0.05 | 0.15 | 2.3 | 0.006 | 0.0023 | 0.03 | 0.100 | 0.020 | 0.004 | 0.15 | 0.15 | 0.15 | 0.15 |
| O | 0.10 | 0.30 | 2.5 | 0.005 | 0.0028 | 0.05 | 0.060 | 0.005 | 0.003 | 0.05 | — | — | — |

TABLE 1-continued

| | | | | | | | | | | | | | |
|---|---|---|---|---|---|---|---|---|---|---|---|---|---|
| P | 0.05 | 0.55 | 2.3 | 0.006 | 0.0023 | 0.03 | 0.060 | 0.005 | 0.003 | 0.15 | 0.15 | — | 0.30 |
| Q | 0.05 | 0.20 | 2.7 | 0.005 | 0.0006 | 0.03 | 0.020 | 0.010 | 0.003 | 0.05 | 0.05 | — | — |
| R | 0.06 | 0.20 | 1.4 | 0.005 | 0.0006 | 0.03 | 0.020 | 0.010 | 0.003 | — | — | 0.25 | 0.25 |
| S | 0.05 | 0.20 | 2.1 | 0.005 | 0.0023 | 0.03 | 0.020 | 0.030 | 0.005 | — | — | 0.25 | 0.30 |
| T | 0.06 | 0.20 | 2.0 | 0.005 | 0.0006 | 0.03 | 0.020 | 0.003 | 0.003 | — | — | — | 0.15 |
| U | 0.05 | 0.30 | 2.0 | 0.007 | 0.0023 | 0.06 | 0.005 | 0.020 | 0.005 | — | — | — | 0.10 |

| Steel No. | Chemical Component (mass %) V | B | Others | Ar3*1 (° C.) | Ms*2 (° C.) | Notes |
|---|---|---|---|---|---|---|
| A | 0.05 | — | — | 740 | 468 | Comparative Steel |
| B | — | — | REM: 0.0040 | 725 | 459 | Invention Steel |
| C | — | — | Ca: 0.0015 | 716 | 453 | Invention Steel |
| D | — | — | Ca: 0.0020 | 725 | 455 | Invention Steel |
| E | — | — | — | 719 | 457 | Invention Steel |
| F | — | — | — | 701 | 450 | Invention Steel |
| G | — | — | — | 708 | 449 | Invention Steel |
| H | 0.10 | — | — | 723 | 443 | Invention Steel |
| I | — | — | — | 692 | 433 | Invention Steel |
| J | — | — | Zr: 0.0100 | 693 | 438 | Invention Steel |
| K | — | 0.0030 | Mg: 0.0020 | 717 | 443 | Invention Steel |
| L | — | — | — | 732 | 457 | Invention Steel |
| M | 0.05 | 0.0010 | — | 720 | 445 | Invention Steel |
| N | — | — | — | 685 | 435 | Comparative Steel |
| O | — | — | — | 678 | 417 | Comparative Steel |
| P | — | — | — | 675 | 438 | Comparative Steel |
| Q | — | — | — | 675 | 426 | Comparative Steel |
| R | — | — | — | 756 | 468 | Comparative Steel |
| S | — | — | — | 699 | 444 | Comparative Steel |
| T | — | — | — | 719 | 450 | Comparative Steel |
| U | — | — | — | 727 | 455 | Comparative Steel |

The balance of the composition is Fe and unavoidable impurities.

*1 $Ar_3$ (° C.) = 910 − 310C − 80Mn − 20Cu − 15Cr − 55Ni − 80Mo (Symbols of elements respectively denote the content (mass %) of the corresponding element of a steel. The symbol of an element which is not included is assigned a value of 0.)

*2 Ms (° C.) = 550 − 361C − 39Mn − 35V − 20Cr − 17Ni − 10Cu − 5(Mo + W) + 15Co + 30Al (Symbols of elements respectively denote the content (mass %) of the corresponding element of a steel. The symbol of an element which is not included is assigned a value of 0.)

TABLE 2

| Steel Plate No. | Steel No. | Ar3*1 (° C.) | Ms*2 (° C.) | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling Finish Temperature (° C.) | Cooling Start Temperature (° C.) | Cooling Rate (° C./s) | Cooling Stop Temperature (° C.) | Holding Time at Cooling Stop Temperature ± 50° C. | Notes |
|---|---|---|---|---|---|---|---|---|---|---|---|---|
| 1 | A | 740 | 468 | 1150 | 65 | 68 | 840 | 790 | 30 | 500 | 100 | Comparative Example |
| 2 | B | 725 | 459 | 1150 | 65 | 68 | 825 | 775 | 30 | 490 | 100 | Invention Example |
| 3 | C | 716 | 453 | 1150 | 65 | 68 | 815 | 765 | 30 | 480 | 100 | Invention Example |
| 4 | D | 725 | 455 | 1150 | 65 | 68 | 825 | 775 | 30 | 490 | 100 | Invention Example |
| 5 | E | 719 | 457 | 1150 | 65 | 68 | 820 | 770 | 30 | 490 | 100 | Invention Example |
| 6 | F | 701 | 450 | 1150 | 65 | 68 | 800 | 750 | 30 | 480 | 100 | Invention Example |
| 7 | G | 708 | 449 | 1150 | 65 | 68 | 810 | 760 | 30 | 480 | 100 | Invention Example |
| 8 | H | 723 | 443 | 1150 | 65 | 68 | 820 | 770 | 30 | 470 | 100 | Invention Example |
| 9 | I | 692 | 433 | 1150 | 65 | 68 | 790 | 740 | 30 | 460 | 100 | Invention Example |
| 10 | J | 693 | 438 | 1150 | 65 | 68 | 790 | 740 | 30 | 470 | 100 | Invention Example |
| 11 | K | 717 | 443 | 1250 | 65 | 68 | 820 | 770 | 30 | 470 | 100 | Invention Example |
| 12 | L | 732 | 457 | 1250 | 65 | 68 | 830 | 780 | 30 | 490 | 100 | Invention Example |
| 13 | M | 720 | 445 | 1250 | 65 | 68 | 820 | 770 | 30 | 480 | 100 | Invention Example |

TABLE 2-continued

| Steel Plate No. | Steel No. | Ar3*1 (° C.) | Ms*2 (° C.) | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling Finish Temperature (° C.) | Cooling Start Temperature (° C.) | Cooling Rate (° C./s) | Cooling Stop Temperature (° C.) | Holding Time at Cooling Stop Temperature ± 50° C. | Notes |
|---|---|---|---|---|---|---|---|---|---|---|---|---|
| 14 | N | 685 | 435 | 1250 | 65 | 68 | 785 | 735 | 30 | 470 | 100 | Comparative Example |
| 15 | O | 678 | 417 | 1250 | 65 | 68 | 780 | 730 | 30 | 450 | 100 | Comparative Example |
| 16 | P | 675 | 438 | 1150 | 65 | 68 | 775 | 725 | 30 | 470 | 100 | Comparative Example |
| 17 | Q | 675 | 426 | 1150 | 65 | 68 | 775 | 725 | 30 | 460 | 100 | Comparative Example |
| 18 | R | 756 | 468 | 1150 | 65 | 68 | 855 | 805 | 30 | 500 | 100 | Comparative Example |
| 19 | S | 699 | 444 | 1150 | 65 | 68 | 800 | 750 | 30 | 480 | 100 | Comparative Example |
| 20 | T | 719 | 450 | 1150 | 65 | 68 | 820 | 770 | 30 | 480 | 100 | Comparative Example |
| 21 | U | 727 | 455 | 1150 | 65 | 68 | 830 | 780 | 30 | 485 | 100 | Comparative Example |

*1 $Ar_3$ (° C.) = 910 − 310C − 80Mn − 20Cu − 15Cr − 55Ni − 80Mo (Symbols of elements respectively denote the content (mass %) of the corresponding element of a steel. The symbol of an element which is not included is assigned a value of 0.)
*2 Ms (° C.) = 550 − 361C − 39Mn − 35V − 20Cr − 17Ni − 10Cu − 5(Mo + W) + 15Co + 30Al (Symbols of elements respectively denote the content (mass %) of the corresponding element of a steel. The symbol of an element which is not included is assigned a value of 0.)

A full-thickness tensile test specimen in accordance with API-5L whose tensile direction is a C direction was taken from the steel plate obtained in the above manner and subjected to a tensile test to determine its yield strength (YS) and tensile strength (TS). A 2 mm V-notched Charpy test specimen whose longitudinal direction was a C direction was taken from the ½ position in the thickness direction and subjected to a Charpy impact test in accordance with ASTM A370 at −40° C. to determine its Charpy impact absorbed energy ($vE_{-40°\ C.}$). Furthermore, a press-notched full-thickness DWTT test specimen in accordance with API-5L whose longitudinal direction was a C direction was taken, and an impact bending load was applied to the test specimen at −40° C. using a drop weight to determine the percent ductile fracture ($SA_{-40°\ C.}$) of a fractured surface. A test specimen for microstructure observation was taken from the ½ position in the thickness direction, and in a manner described below, a microstructure was identified, and the area fraction of bainite, Martensite-Austenite constituent, and other constituents and the average particle size of cementite were determined.

<Microstructure Observation>

A test specimen for microstructure observation was taken from the ½ position in the thickness direction of the steel plate. An L cross-section (a vertical cross-section parallel to a rolling direction) of the test specimen was mirror-polished and etched with nital. Five fields of view were randomly selected and observed using a scanning electron microscope (SEM) at a magnification of 2000×. Microstructural images were taken to identify a microstructure. The microstructure was subjected to image analysis to determine the area fraction of phases such as bainite, martensite, ferrite, and pearlite.

Next, the same sample was electrolytically etched (electrolyte: 100 ml of distilled water+25 g of sodium hydroxide+5 g of picric acid) to expose Martensite-Austenite constituent alone. Five fields of view were randomly selected and observed using a SEM at a magnification of 2000×. Microstructural images were taken and subjected to image analysis to determine the Martensite-Austenite constituent area fraction at the ½ position in the thickness direction.

Furthermore, mirror polishing was performed again, and cementite was then extracted by selective potentiostatic electrolytic etching by electrolytic dissolution method (electrolyte: 10% by volume acetylacetone+1% by volume tetramethylammonium chloride methyl alcohol). Five fields of view are randomly selected and observed using a SEM at a magnification of 2000×, and microstructural images taken were subjected to image analysis to determine the average cementite particle size (equivalent circle diameter) at the ½ position in the thickness direction.

The results obtained are shown in Table 3.

TABLE 3

| Steel | | Steel Microstructure | | | | | Base Metal Tensile Properties | | Base Metal Toughness | | |
|---|---|---|---|---|---|---|---|---|---|---|---|
| Plate No. | Steel No. | Bainite Area Fraction (%) | Particle Size of Cementite in Bainite (μm) | Martensite-Austenite Constituent Area Fraction (%) | Other Constituent*1 | Other Constituent Area Fraction (%) | YS (MPa) | TS (Mpa) | $vE_{40°\ C.}$ (J) | DWTT $SA_{40°\ C.}$ (%) | Notes |
| 1 | A | 87 | 0.4 | 1 | F, P | 12 | 549 | 590 | 450 | 90 | Comparative Example |
| 2 | B | 98 | 0.2 | 1 | F | 3 | 671 | 722 | 423 | 90 | Invention Example |

TABLE 3-continued

| Steel | | Steel Microstructure | | | | | Base Metal Tensile Properties | | Base Metal Toughness | | |
|---|---|---|---|---|---|---|---|---|---|---|---|
| | | Bainite Area | Particle Size of Cementite | Martensite-Austenite Constituent Area | | Other Constituent Area | | | | | |
| Plate No. | Steel No. | Fraction (%) | in Bainite (μm) | Fraction (%) | Other Constituent*1 | Fraction (%) | YS (MPa) | TS (Mpa) | $vE_{40° C.}$ (J) | DWTT $SA_{40° C.}$ (%) | Notes |
| 3 | C | 97 | 0.2 | 1 | F | 2 | 685 | 737 | 419 | 90 | Invention Example |
| 4 | D | 92 | 0.2 | 2 | F | 6 | 610 | 656 | 442 | 95 | Invention Example |
| 5 | E | 92 | 0.2 | 2 | F | 6 | 609 | 655 | 445 | 95 | Invention Example |
| 6 | F | 96 | 0.2 | 1 | F | 3 | 671 | 722 | 423 | 90 | Invention Example |
| 7 | G | 95 | 0.2 | 1 | F | 4 | 651 | 700 | 430 | 90 | Invention Example |
| 8 | H | 92 | 0.2 | 2 | F | 6 | 610 | 656 | 442 | 95 | Invention Example |
| 9 | I | 99 | 0.3 | 1 | — | — | 706 | 759 | 413 | 90 | Invention Example |
| 10 | J | 100 | 0.2 | 0 | — | — | 733 | 788 | 405 | 85 | Invention Example |
| 11 | K | 92 | 0.2 | 2 | F | 6 | 603 | 649 | 444 | 95 | Invention Example |
| 12 | L | 93 | 0.2 | 2 | F | 5 | 617 | 663 | 440 | 95 | Invention Example |
| 13 | M | 92 | 0.2 | 1 | F | 7 | 603 | 649 | 443 | 95 | Invention Example |
| 14 | N | 80 | 0.2 | 0 | M | 20 | 671 | 839 | 305 | 75 | Comparative Example |
| 15 | O | 70 | 0.4 | 0 | M | 30 | 630 | 900 | 195 | 70 | Comparative Example |
| 16 | P | 74 | 0.2 | 6 | M | 20 | 666 | 840 | 300 | 75 | Comparative Example |
| 17 | Q | 80 | 0.2 | 0 | M | 20 | 655 | 825 | 315 | 80 | Comparative Example |
| 18 | R | 86 | 0.4 | 2 | F, P | 12 | 535 | 575 | 453 | 90 | Comparative Example |
| 19 | S | 80 | 0.2 | 0 | M | 20 | 660 | 832 | 310 | 75 | Comparative Example |
| 20 | T | 94 | 0.2 | 1 | F | 5 | 600 | 641 | 380 | 80 | Comparative Example |
| 21 | U | 85 | 0.3 | 0 | F, P | 15 | 546 | 580 | 440 | 80 | Comparative Example |

*1F: Ferrite, P: Pearlite, M: Martensite

Table 3 shows that steel plates of Nos. 2 to 13, which are Invention Examples where compositions and production methods are in accordance with the present invention, are high-strength, high-toughness steel plates having a high absorbed energy, the steel plates each including a base metal having a tensile strength (TS) of 625 MPa or more, a Charpy impact absorbed energy at −40° C. ($vE_{-40° C.}$) of 375 J or more, and a percent ductile fracture ($SA_{-40° C.}$) as determined by a DWTT at −40° C. of 85% or more.

In contrast, No. 1 and No. 18, which are Comparative Examples, are not provided with the desired tensile strength (TS), because the C content of No. 1 and the Mn content of No. 18 are each below the range of the present invention and then the amount of ferrite and pearlite formed during cooling is large and a predetermined amount of bainite is not formed. No. 14, No. 15, and No. 17, which are Comparative Examples, are not provided with the desired Charpy impact absorbed energy ($vE_{-40° C.}$) or the desired DWTT properties ($SA_{-40° C.}$), because the Nb content of No. 14, the C content of No. 15, and the Mn content of No. 17 are each over the range of the present invention, and then the amount of hard martensite formation is increased after accelerated cooling. No. 16, which is a Comparative Example, is not provided with the desired Charpy impact absorbed energy ($vE_{-40° C.}$) or the desired DWTT properties ($SA_{-40° C.}$), because the Si content is over the range of the present invention and then the area fraction of Martensite-Austenite constituent which may be the initiation site of a ductile crack or a brittle crack is large. No. 19, which is a Comparative Example, is not provided with the desired Charpy impact absorbed energy ($vE_{-40° C.}$) or the desired DWTT properties ($SA_{-40° C.}$), because the Ti content is over the range of the present invention and then TiN is coarsened to be the initiation site of a ductile crack or a brittle crack. No. 20, which is a Comparative Example, is not provided with the desired DWTT properties ($SA_{-40° C.}$), because the Ti content is below the range of the present invention and then an austenite grain refining effect of a pinning effect of a nitride (TiN) is not produced. No. 21, which is a Comparative Example, is not provided with the desired DWTT properties ($SA_{-40° C.}$), because the Nb content is below the range of the present invention and then a grain refining effect of rolling in a non-recrystallization range is not produced. In addition, No. 21 is not provided with the desired tensile strength (TS), because the amount of ferrite and pearlite formed during cooling is large and a predetermined amount of bainite is not formed.

EXAMPLE 2

Molten steels having compositions of steels B, F, and K (the balance is Fe and unavoidable impurities) shown in Table 1 were each smelted in a converter and cast into a slab having a thickness of 220 mm. The slab was then subjected to hot rolling, accelerated cooling, holding after accelerated cooling under conditions shown in Table 4 and naturally cooled to a temperature range of 100° C. or lower (room temperature) to produce a steel plate having a thickness of 25 mm.

TABLE 4

| Steel Plate No. | Steel No. | Ar3*1 (° C.) | Ms*2 (° C.) | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling finish Temperature (° C.) | Cooling Start Temperature (° C.) | Cooling Rate (° C./s) | Cooling Stop Temperature (° C.) | Holding Time at Cooling Stop Temperature ± 50° C. | Notes |
|---|---|---|---|---|---|---|---|---|---|---|---|---|
| 22 | B | 725 | 459 | 1150 | 65 | 68 | 825 | 775 | 30 | 490 | 100 | Invention Example |
| 23 | B | 725 | 459 | 1100 | 50 | 81 | 800 | 750 | 30 | 470 | 50 | Invention Example |
| 24 | B | 725 | 459 | 1100 | 65 | 68 | 850 | 800 | 15 | 540 | 50 | Invention Example |
| 25 | B | 725 | 459 | 1300 | 65 | 68 | 825 | 775 | 30 | 490 | 100 | Comparative Example |
| 26 | B | 725 | 459 | 1150 | 65 | 68 | 890 | 840 | 30 | 490 | 100 | Comparative Example |
| 27 | B | 725 | 458 | 950 | 65 | 68 | 825 | 775 | 30 | 490 | 100 | Comparative Example |
| 28 | B | 725 | 459 | 1150 | 65 | 68 | 750 | 700 | 30 | 490 | 100 | Comparative Example |
| 29 | B | 725 | 459 | 1150 | 65 | 68 | 825 | 775 | 3 | 490 | 100 | Comparative Example |
| 30 | B | 725 | 459 | 1150 | 65 | 68 | 825 | 775 | 30 | 490 | 10 | Comparative Example |
| 31 | B | 725 | 459 | 1150 | 65 | 68 | 825 | 775 | 30 | 490 | 500 | Comparative Example |
| 32 | B | 725 | 459 | 1150 | 65 | 68 | 825 | 775 | 30 | 600 | 100 | Comparative Example |
| 33 | B | 725 | 459 | 1150 | 65 | 68 | 825 | 775 | 30 | 300 | 100 | Comparative Example |
| 34 | F | 701 | 450 | 1150 | 65 | 68 | 800 | 750 | 30 | 480 | 100 | Invention Example |
| 35 | F | 701 | 450 | 1100 | 55 | 75 | 825 | 775 | 30 | 460 | 200 | Invention Example |
| 36 | F | 701 | 450 | 1100 | 65 | 68 | 800 | 750 | 15 | 530 | 200 | Invention Example |
| 37 | F | 701 | 450 | 1150 | 65 | 68 | 800 | 750 | 30 | 600 | 100 | Comparative Example |
| 38 | F | 701 | 450 | 1150 | 65 | 68 | 800 | 750 | 30 | 480 | 500 | Comparative Example |
| 39 | K | 717 | 443 | 1250 | 65 | 68 | 820 | 770 | 30 | 470 | 100 | Invention Example |
| 40 | K | 717 | 443 | 1250 | 65 | 68 | 800 | 750 | 30 | 450 | 100 | Invention Example |
| 41 | K | 717 | 443 | 1250 | 65 | 68 | 820 | 770 | 100 | 470 | 100 | Comparative Example |
| 42 | K | 717 | 443 | 1250 | 65 | 68 | 820 | 770 | 30 | 350 | 100 | Comparative Example |
| 43 | K | 717 | 443 | 1250 | 65 | 68 | 820 | 770 | 30 | 470 | 10 | Comparative Example |

*1 $Ar_3$ (° C.) = 910 − 310C − 80Mn − 20Cu − 15Cr − 55Ni − 80Mo (Symbols of elements respectively denote the content (mass %) of the corresponding element of a steel. The symbol of an element which is not included is assigned a value of 0.)
*2 Ms (° C.) = 550 − 361C − 39Mn − 35V − 20Cr − 17Ni − 10Cu − 5(Mo + W) + 15Co + 30Al (Symbols of elements respectively denote the content (mass %) of the corresponding element of a steel. The symbol of an element which is not included is assigned a value of 0.)

The steel plates obtained in the above manner were subjected to a full-thickness tensile test, a Charpy impact test, and a press-notched full-thickness DWTT in the same manner as in Example 1 to determine their yield strength (YS), tensile strength (TS), Charpy impact absorbed energy ($vE_{-40°\ C.}$), and percent ductile fracture ($SA_{-40°\ C.}$). The results obtained are shown in Table 5.

TABLE 5

| Steel | | Steel Microstructure | | | | | Base Metal Tensile Properties | | Base Metal Toughness | | |
|---|---|---|---|---|---|---|---|---|---|---|---|
| | | Bainite Area | Particle Size of Cementite | Martensite-Austenite Constituent Area | | Other Constituent Area | | | | | |
| Plate No. | Steel No. | Fraction (%) | in Bainite (μm) | Fraction (%) | Other Constituent*1 | Fraction (%) | YS (MPa) | TS (MPa) | $vE_{40° C.}$ (J) | DWTT $SA_{40° C.}$ (%) | Notes |
| 22 | B | 96 | 0.2 | 1 | F | 3 | 671 | 722 | 423 | 90 | Invention Example |
| 23 | B | 98 | 0.2 | 0 | F | 2 | 675 | 726 | 433 | 95 | Invention Example |
| 24 | B | 96 | 0.4 | 2 | F | 2 | 679 | 730 | 410 | 85 | Invention Example |
| 25 | B | 96 | 0.2 | 1 | F | 3 | 661 | 712 | 345 | 75 | Comparative Example |
| 26 | B | 97 | 0.2 | 1 | F | 2 | 665 | 717 | 360 | 80 | Comparative Example |
| 27 | B | 93 | 0.1 | 0 | F | 7 | 555 | 610 | 440 | 90 | Comparative Example |
| 28 | B | 86 | 0.2 | 1 | F | 13 | 545 | 580 | 340 | 90 | Comparative Example |
| 29 | B | 83 | 0.3 | 1 | F, P | 16 | 549 | 590 | 450 | 90 | Comparative Example |
| 30 | B | 96 | Unprecipitated | 2 | F | 2 | 670 | 718 | 370 | 80 | Comparative Example |
| 31 | B | 91 | 0.7 | 2 | F | 7 | 670 | 710 | 355 | 80 | Comparative Example |
| 32 | B | 91 | 0.8 | 5 | F | 4 | 590 | 735 | 350 | 80 | Comparative Example |
| 33 | B | 69 | 0.1 | 1 | M | 30 | 652 | 820 | 220 | 70 | Comparative Example |
| 34 | F | 96 | 0.2 | 1 | F | 3 | 671 | 722 | 423 | 90 | Invention Example |
| 35 | F | 97 | 0.2 | 0 | F | 3 | 673 | 724 | 432 | 95 | Invention Example |
| 36 | F | 96 | 0.4 | 2 | F | 2 | 677 | 728 | 408 | 85 | Invention Example |
| 37 | F | 92 | 0.8 | 6 | F | 2 | 592 | 740 | 360 | 80 | Comparative Example |
| 38 | F | 91 | 0.7 | 2 | F | 7 | 600 | 745 | 355 | 80 | Comparative Example |
| 39 | K | 92 | 0.2 | 2 | F | 6 | 603 | 649 | 444 | 95 | Invention Example |
| 40 | K | 94 | 0.2 | 1 | F | 5 | 609 | 655 | 442 | 95 | Invention Example |
| 41 | K | 79 | 0.1 | 1 | M | 20 | 600 | 750 | 250 | 75 | Comparative Example |
| 42 | K | 69 | 0.1 | 1 | M | 30 | 621 | 780 | 220 | 70 | Comparative Example |
| 43 | K | 92 | Unprecipitated | 2 | F | 6 | 600 | 652 | 370 | 80 | Comparative Example |

*1F: Ferrite, P: Pearlite, M: Martensite

Table 5 shows that steel plates of Nos. 22 to 24, 34 to 36, 39, and 40 satisfying the production conditions of the present invention, which are Invention Examples where compositions and production methods are in accordance with the present invention, are high-strength, high-toughness steel plates having a high absorbed energy, the steel plates each including a base metal having a tensile strength (TS) of 625 MPa or more, a Charpy impact absorbed energy at −40° C. ($vE_{-40° C.}$) of 375 J or more, and a percent ductile fracture as determined by a DWTT at −40° C. ($SA_{-40° C.}$) of 85% or more. Among the steel plates having the same composition, No. 23 and No. 35 are superior in Charpy impact absorbed energy ($vE_{-40° C.}$) and DWTT properties ($SA_{-40° C.}$), because the accumulated rolling reduction ratio in a non-recrystallization temperature range is in a preferred range, so that austenite grains are refined.

In contrast, No. 25, which is a Comparative Example, is not provided with the desired Charpy impact absorbed energy ($vE_{-40° C.}$) or the desired DWTT properties ($SA_{-40° C.}$), because the slab heating temperature is over the range of the present invention and then initial austenite grains are coarsened. No. 26, which is a Comparative Example, is not provided with the desired Charpy impact absorbed energy ($vE_{-40° C.}$) or the desired DWTT properties ($SA_{-40° C.}$), because the rolling finish temperature and the cooling start temperature, which varies with the rolling finish temperature, are each over the range of the present invention and then a grain refining effect that is effective in improving DWTT properties is not sufficiently produced. No. 27, which is a Comparative Example, is not provided with the desired tensile strength (TS), because the slab heating temperature is below the range of the present invention, which causes carbides of Nb, V, and other elements in a steel slab are not sufficiently dissolved, and then a strength-increasing effect of precipitation strengthening is not produced. No. 28, which is a Comparative Example, is not provided with the desired tensile strength (TS), because the rolling finish temperature and the cooling start temperature are each below the range of the present invention and then the amount of ferrite formed during rolling or during cooling is large and a predetermined amount of bainite is not formed. In addition, No. 23 is not provided with the desired Charpy impact absorbed energy ($vE_{-40° C.}$), because separation occurs under the influence of a texture developed during rolling. No. 29, which is a Comparative Example, is not provided with the desired tensile strength (TS), because the cooling rate in accelerated cooling is below the range of the present invention and then the amount of ferrite and pearlite formed during cooling is large and a predetermined amount of bainite is not formed. No. 32 and No. 37, which are Comparative Examples, are not provided with the desired Charpy impact absorbed energy ($vE_{-40° C.}$) or the desired DWTT properties ($SA_{-40° C.}$), because the cooling stop temperature is over the range of the present invention and then coarse cementite and Martensite-Austenite constituent, which is a result of upper bainite transformation, are significantly formed during a natural cooling process after stopping the cooling. No. 31 and No. 38, which are Comparative Examples, are not provided with the desired Charpy impact absorbed energy ($vE_{-40° C.}$) or the desired DWTT properties ($SA_{-40° C.}$), because the temperature holding time after stopping the accelerated cooling is over the range of the present invention and then cementite in bainite coagulates and is coarsened to be the initiation site of a ductile crack or a brittle crack. No. 41, which is a Comparative Example, is not provided with the desired Charpy impact absorbed energy ($vE_{-40° C.}$) or the desired DWTT properties ($SA_{-40° C.}$), because the cooling rate in accelerated cooling is over the range of the present invention and then the amount of hard martensite formation is increased after accelerated cooling. No. 33 and No. 42, which are Comparative Examples, are not provided with the desired Charpy impact absorbed energy ($vE_{-40° C.}$) or the desired DWTT properties ($SA_{-40° C.}$), because the cooling stop temperature is below the range of the present invention and then the amount of martensite formation is increased. No. 30 and No. 43, which are Comparative Examples, are not provided with the desired Charpy impact absorbed energy ($vE_{-40° C.}$) or the desired DWTT properties ($SA_{-40° C.}$), because the temperature holding time after stopping the accelerated cooling is below the range of the present invention and then supersaturated solute carbon in the bainite formed by transformation as a result of cooling cannot precipitate sufficiently in the form of fine cementite.

INDUSTRIAL APPLICABILITY

Using the high-strength, high-toughness steel plate having a high absorbed energy according to the present invention for a line pipe, which is used for transporting natural gas, crude oil, and the like, can greatly contribute to improving transport efficiency by using higher pressure and to improving on-site welding efficiency by using pipes with thinner walls.

The invention claimed is:

1. A high-strength, high-toughness steel plate having a composition containing, by mass %, C: 0.03% or more and 0.08% or less,
Si: 0.01% or more and 0.50% or less,
Mn: 1.5% or more and 2.5% or less,
P: 0.001% or more and 0.010% or less,
S: 0.0030 or less,
Al: 0.01% or more and 0.08% or less,
Nb: 0.010% or more and 0.080% or less,
Ti: 0.005% or more and 0.025% or less,
N: 0.001% or more and 0.006% or less, and further containing at least one selected from
Cu: 0.01% or more and 1.00% or less,
Ni: 0.01% or more and 1.00% or less,
Cr: 0.01% or more and 1.00% or less,
Mo: 0.01% or more and 1.00% or less,
V: 0.01% or more and 0.10% or less, and
B: 0.0005% or more and 0.0030% or less, with the balance being Fe and unavoidable impurities,
wherein the steel plate has a microstructure in which an area fraction of Martensite-Austenite constituent at a ½ position in a thickness direction is less than 3%,
an area fraction of bainite at the ½ position in the thickness direction is 90% or more, and
an average particle size of cementite present in the bainite at the ½ position in the thickness direction is 0.5 μm or less.

2. The high-strength, high-toughness steel plate according to claim 1, wherein the composition further contains, by mass %, at least one selected from Ca: 0.0005% or more and 0.0100% or less,
REM: 0.0005% or more and 0.0200% or less,
Zr: 0.0005% or more and 0.0300% or less, and
Mg: 0.0005% or more and 0.0100% or less.

3. A method for producing the high-strength, high-toughness steel plate according to claim 1, the method comprising:

heating a steel slab to 1000° C. or higher and 1250° C. or lower;
performing rolling in an austenite recrystallization temperature range;
performing rolling at an accumulated rolling reduction ratio of 60% or more in an austenite non-recrystallization temperature range;
finishing the rolling at a temperature of ($Ar_3$ temperature +50° C.) or higher and ($Ar_3$ temperature +150° C.) or lower;
performing accelerated cooling from a cooling start temperature of $Ar_3$ temperature or higher and ($Ar_3$ temperature +100° C.) or lower to a cooling stop temperature of Ms temperature or higher and (Ms temperature +100° C.) or lower at a cooling rate of 10° C./s or more and 80° C./s or less;
holding the temperature of the steel in a range of the cooling stop temperature ±50° C. for 50 s or longer and shorter than 300 s; and then
performing natural cooling to a temperature range of 100° C. or lower.

4. A method for producing the high-strength, high-toughness steel plate according to claim 2, the method comprising:

heating a steel slab to 1000° C. or higher and 1250° C. or lower;
performing rolling in an austenite recrystallization temperature range;
performing rolling at an accumulated rolling reduction ratio of 60% or more in an austenite non-recrystallization temperature range;
finishing the rolling at a temperature of ($Ar_3$ temperature +50° C.) or higher and ($Ar_3$temperature +150° C.) or lower;
performing accelerated cooling from a cooling start temperature of $Ar_3$ temperature or higher and ($Ar_3$ temperature +100° C.) or lower to a cooling stop temperature of Ms temperature or higher and (Ms temperature +100° C.) or lower at a cooling rate of 10° C./s or more and 80° C./s or less;

holding the temperature of the steel in a range of the cooling stop temperature ±50° C. for 50 s or longer and shorter than 300 s; and then performing natural cooling to a temperature range of 100° C. or lower.

5. The high-strength, high-toughness steel plate according to claim 1, wherein the steel plate includes a base metal having:

i) a tensile strength of 625 MPa or more, measured in accordance with API-5L, ii) a Charpy impact absorbed energy at −40° C. of 375 J or more, measured in accordance with ASTM A370, and iii) a percent ductile fracture (SA value) as determined by a DWTT at −40° C. of 85% or more.

6. The high-strength, high-toughness steel plate according to claim 2, wherein the steel plate includes a base metal having:

i) a tensile strength of 625 MPa or more, measured in accordance with API-5L, ii) a Charpy impact absorbed energy at −40° C. of 375 J or more, measured in accordance with ASTM A370, and iii) a percent ductile fracture (SA value) as determined by a DWTT at −40° C. of 85% or more.

7. The method of claim 3, wherein after the step of accelerated cooling, a reheating step is not performed.

8. The method of claim 4, wherein after the step of accelerated cooling, a reheating step is not performed.

* * * * *